US011559115B2

(12) United States Patent
Harris

(10) Patent No.: US 11,559,115 B2
(45) Date of Patent: Jan. 24, 2023

(54) FLEXIBLE AND BREATHABLE SLIDER ASSEMBLY

(71) Applicant: NIKE, Inc., Beaverton, OR (US)

(72) Inventor: Donavan Harris, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 96 days.

(21) Appl. No.: 17/141,353

(22) Filed: Jan. 5, 2021

(65) Prior Publication Data

US 2021/0235821 A1 Aug. 5, 2021

Related U.S. Application Data

(60) Provisional application No. 62/968,313, filed on Jan. 31, 2020.

(51) Int. Cl.
*A44B 19/26* (2006.01)
*A44B 19/34* (2006.01)

(52) U.S. Cl.
CPC ..... *A44B 19/26* (2013.01); *A44B 19/34* (2013.01)

(58) Field of Classification Search
CPC ..... A44B 19/26; A44B 19/34; A41H 37/003; A41D 2300/322; A41D 27/28
See application file for complete search history.

(56) References Cited

U.S. PATENT DOCUMENTS 1,508,133 A 9/1924 Sundback
2,012,755 A 8/1935 De Muth
2,353,984 A 7/1944 Barone
2,385,124 A 9/1945 Barone
2,652,705 A 9/1953 Weinberg
3,444,598 A 5/1969 Glindmeyer et al.
(Continued)

FOREIGN PATENT DOCUMENTS

CN 201782133 U 4/2011
EP 0922403 B1 7/2003
(Continued)

OTHER PUBLICATIONS

International Search Report and Written Opinion received for PCT Patent Application No. PCT/US2021/012311, dated Apr. 20, 2021, 7 pages.

(Continued)

*Primary Examiner* — Robert Sandy
*Assistant Examiner* — Louis A Mercado
(74) *Attorney, Agent, or Firm* — Shook Hardy & Bacon, LLP

(57) ABSTRACT

Aspects herein are directed to a flexible and breathable slider assembly for an article of apparel. The slider assembly includes a first slider tape having a first longitudinal edge with a first series of alternating peaks and troughs and a second longitudinal edge. The slider assembly also includes a third longitudinal edge with a second series of alternating peaks and troughs and a fourth longitudinal edge. A first textile edge of the article is attached to respective peaks of the first series of peaks but is unattached from respective troughs of the first series of troughs to form a first series of spaces. A second textile edge of the article is attached to respective peaks of the second series of peaks but is unattached from respective troughs of the second series of troughs to form a second series of spaces.

14 Claims, 12 Drawing Sheets

(56) References Cited

U.S. PATENT DOCUMENTS

| | | | | |
|---|---|---|---|---|
| 4,019,227 | A | 4/1977 | Ebata | |
| 4,125,911 | A | 11/1978 | Moertel | |
| 4,392,363 | A | 7/1983 | Matsuda | |
| 4,488,337 | A | 12/1984 | Yoshida et al. | |
| 4,619,004 | A | 10/1986 | Won | |
| D331,892 | S | 12/1992 | Semons | |
| D407,668 | S | 4/1999 | Okeya | |
| 8,336,116 | B2 | 12/2012 | Seguin et al. | |
| D682,156 | S | 5/2013 | Caldwell | |
| 2002/0157221 | A1* | 10/2002 | Chou | A44B 19/34 24/381 |
| 2005/0034284 | A1 | 2/2005 | Yu | |
| 2006/0059601 | A1 | 3/2006 | Opitz et al. | |
| 2008/0086851 | A1 | 4/2008 | Miyazaki | |
| 2012/0017346 | A1 | 1/2012 | Reimer | |
| 2020/0214402 | A1* | 7/2020 | Ly | A44B 19/34 |
| 2022/0087372 | A1* | 3/2022 | Roup | B29D 5/02 |

FOREIGN PATENT DOCUMENTS

| | | | |
|---|---|---|---|
| WO | 2004/034834 | A1 | 4/2004 |
| WO | 2014/010078 | A1 | 1/2014 |

OTHER PUBLICATIONS

"Lightweight & Breathable Lace Tape Plastic Zipper for Sportswear", Alibaba, Available online at: <https://www.alibaba.com/product-detail/Lightweight-Breathable-Lace-Tape-Plastic-Zipper_60522683035.html>, Accessed on Aug. 26, 2019, 5 pages.

International Preliminary Report on Patentability received for PCT Patent Application No. PCT/US2021/012311, dated Aug. 11, 2022, 10 pages.

* cited by examiner

FLEXIBLE AND BREATHABLE SLIDER ASSEMBLY

CROSS-REFERENCE TO RELATED APPLICATIONS

This application, Ser. No. 17/141,353 and entitled "Flexible and Breathable Slider Assembly," claims the benefit of priority of U.S. Prov. App. No. 62/968,313, filed Jan. 31, 2020, and entitled "Flexible and Breathable Slider Assembly." The entirety of the aforementioned application is incorporated by reference herein.

TECHNICAL FIELD

Aspects herein are directed to a slider assembly, and articles of apparel incorporating the same, where the slider assembly is flexible and breathable.

BACKGROUND

Typical slider assemblies include slider tapes having linear longitudinal edges, which may make it difficult for the slider assembly to flex in a direction orthogonal to the linear edges. Further, typical slider assemblies generally lack features that facilitate breathability and/or permeability when the slider assembly is incorporated into an article of apparel.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A slider assembly comprising: a first slider tape having a first longitudinal edge that includes a first series of alternating peaks and troughs and a second longitudinal edge opposite the first longitudinal edge to which a first set of coupling elements are attached; and a second slider tape having a third longitudinal edge that includes a second series of alternating peaks and troughs and a fourth longitudinal edge opposite the third longitudinal edge to which a second set of coupling elements are attached, wherein the first set of coupling elements are either engaged with, partially engaged with, or disengaged from the second set of coupling elements.

Clause 2. The slider assembly according to clause 1, wherein the second longitudinal edge of the first slider tape is linear.

Clause 3. The slider assembly according to any of clauses 1 through 2, wherein the fourth longitudinal edge of the second slider tape is linear.

Clause 4. The slider assembly according to any of clauses 1 through 3, wherein the first set of coupling elements and the second set of coupling elements comprise zipper teeth.

Clause 5. The slider assembly according to any of clauses 1 through 4, wherein peaks in the first series of peaks of the first slider tape are aligned with peaks in the second series of peaks of the second slider tape across a width of the slider assembly when the first set of coupling elements are engaged with the second set of coupling elements.

Clause 6. The slider assembly according to any of clauses 1 through 6, wherein troughs in the first series of troughs of the first slider tape are aligned with troughs in the second series of troughs of the second slider tape across a width of the slider assembly when the first set of coupling elements are engaged with the second set of coupling elements.

Clause 7. An article of apparel incorporating a slider assembly, the article of apparel comprising: a first textile having a first textile edge and a second textile having a second textile edge; a first slider tape of the slider assembly, the first slider tape having a first longitudinal edge that includes a first series of alternating peaks and troughs and a second longitudinal edge opposite the first longitudinal edge to which a first set of coupling elements are attached, wherein the first textile edge is affixed to the first series of peaks and is unaffixed from the first series of troughs such that a space is formed between the first textile edge and respective troughs of the first series of troughs; and a second slider tape of the slider assembly, the second slider tape having a third longitudinal edge that includes a second series of alternating peaks and troughs and a fourth longitudinal edge opposite the third longitudinal edge to which a second set of coupling elements are attached, wherein the second textile edge is affixed to the second series of peaks and is unaffixed from the second series of troughs such that a space is formed between the second textile edge and respective troughs of the second series of troughs.

Clause 8. The article of apparel incorporating the slider assembly according to clause 7, wherein the second longitudinal edge of the first slider tape is linear, and wherein the fourth longitudinal edge of the second slider tape is linear.

Clause 9. The article of apparel incorporating the slider assembly according to any of clauses 7 through 8, wherein the first slider tape is affixed to an internal-facing surface of the first textile, and wherein the second slider tape is affixed to an internal-facing surface of the second textile.

Clause 10. The article of apparel incorporating the slider assembly according to any of clauses 7 through 9, wherein the slider assembly further comprises a slider pull, and wherein the slider pull is positioned on an external-facing surface of the article of apparel.

Clause 11. The article of apparel incorporating the slider assembly according to any of clauses 7 through 11, wherein the first textile edge is affixed to the first series of peaks of the first slider tape using zig-zag stitching, and wherein the second textile edge is affixed to the second series of peaks of the second slider tape using zig-zag stitching.

Clause 12. The article of apparel incorporating the slider assembly according to any of clauses 7 through 11, wherein the space formed between the first textile edge and the respective troughs of the first series of troughs is from about 1.5 mm to about 2.5 mm in width.

Clause 13. The article of apparel incorporating the slider assembly according to any of clauses 7 through 12, wherein the space formed between the second textile edge and the respective troughs of the second series of troughs is from about 1.5 mm to about 2.5 mm in width.

Clause 14. The article of apparel incorporating the slider assembly according to any of clauses 7 through 13, wherein the first set of coupling elements and the second set of coupling elements comprise zipper teeth.

Clause 15. The article of apparel incorporating the slider assembly according to any of clauses 7 through 14, wherein the first set of coupling elements are either engaged with, partially engaged with, or disengaged from the second set of coupling elements.

Clause 16. The article of apparel incorporating the slider assembly according to clause 15, wherein peaks in the first series of peaks of the first slider tape are aligned with peaks in the second series of peaks of the second slider tape across a width of the slider assembly when the first set of coupling elements are engaged with the second set of coupling elements.

Clause 17. The article of apparel incorporating the slider assembly according to any of clauses 15 through 16, wherein troughs in the first series of troughs of the first slider tape are aligned with troughs in the second series of troughs of the second slider tape across a width of the slider assembly when the first set of coupling elements are engaged with the second set of coupling elements.

Clause 18. A method of manufacturing an article of apparel incorporating a slider assembly, the method comprising: affixing a first textile edge of the article of apparel to a first longitudinal edge of a first slider tape of the slider assembly, the first longitudinal edge of the first slider tape including a first series of alternating peaks and troughs, wherein the first textile edge is affixed to the first series of peaks and is unaffixed from the first series of troughs such that a space is formed between the first textile edge and respective troughs of the first series of troughs, the first slider tape further including a second longitudinal edge opposite the first longitudinal edge to which a first set of coupling elements are attached; and affixing a second textile edge of the article of apparel to a third longitudinal edge of a second slider tape of the slider assembly, the third longitudinal edge of the second slider tape including a second series of alternating peaks and troughs, wherein the second textile edge is affixed to the second series of peaks and is unaffixed from the second series of troughs such that a space is formed between the second textile edge and respective troughs of the second series of troughs, and wherein the second slider tape further includes a fourth longitudinal edge opposite the third longitudinal edge to which a second set of coupling elements are attached.

Clause 19. The method of manufacturing the article of apparel incorporating the slider assembly according to clause 18, wherein the space formed between the first textile edge and the respective troughs of the first series of troughs is from about 1.5 mm to about 2.5 mm in width, and wherein the space formed between the second textile edge and the respective troughs of the second series of troughs is from about 1.5 mm to about 2.5 mm in width.

Clause 20. The method of manufacturing the article of apparel incorporating the slider assembly according to any of clauses 18 through 19, wherein the first textile edge is affixed to the first series of peaks of the first slider tape using zig-zag stitching, and wherein the second textile edge is affixed to the second series of peaks of the second slider tape using zig-zag stitching.

Clause 21. A slider assembly comprising: a first slider tape having a first longitudinal edge that includes a first series of alternating peaks and troughs and a second longitudinal edge opposite the first longitudinal edge to which a first set of coupling elements are attached; and a second slider tape having a third longitudinal edge that includes a second series of alternating peaks and troughs and a fourth longitudinal edge opposite the third longitudinal edge to which a second set of coupling elements are attached.

Clause 22. The slider assembly according to clause 21, wherein a peak of the first series of peaks is aligned across a width of the slider assembly with a trough of the second series of troughs, and wherein a trough of the first series of troughs is aligned across the width of the slider assembly with a peak of the second series of peaks.

Clause 23. The slider assembly according to clause 21, wherein a peak of the first series of peaks is aligned across a width of the slider assembly with a peak of the second series of peaks, and wherein a trough of the first series of troughs is aligned across the width of the slider assembly with a trough of the second series of troughs.

Clause 24. The slider assembly according to any of clauses 21 through 23, wherein an apex region of a first peak of the first series of peaks is positioned a first distance from a midline of the slider assembly, and wherein an apex region of a second peak of the first series of peaks is positioned a second distance from the midline of the slider assembly, the first distance being greater than the second distance.

Clause 25. The slider assembly according to clause 24, wherein an apex region of a first peak of the second series of peaks is positioned a first distance from a midline of the slider assembly, and wherein an apex region of a second peak of the second series of peaks is positioned a second distance from the midline of the slider assembly, the first distance being greater than the second distance.

Clause 26. The slider assembly according to any of clauses 21 through 25, wherein a first distance between a first peak and an adjacent second peak of the first series of peaks is greater than a second distance between the second peak and an adjacent third peak of the first series of peaks.

Clause 27. The slider assembly according to clause 26, wherein a first distance between a first peak and an adjacent second peak of the second series of peaks is greater than a second distance between the second peak and an adjacent third peak of the second series of peaks.

Clause 28. The slider assembly according to any of clauses 21 through 27, wherein one or more of an apex region of the first series of peaks and an apex region of the first series of troughs include two right angles separated by a line segment.

Clause 29. The slider assembly according to clause 28, wherein one or more of an apex region of the second series of peaks and an apex region of the second series of troughs include two right angles separated by a line segment.

BRIEF DESCRIPTION OF THE DRAWINGS

Examples of aspects herein are described in detail below with reference to the attached drawing figures, wherein.

DETAILED DESCRIPTION

Figure 1:
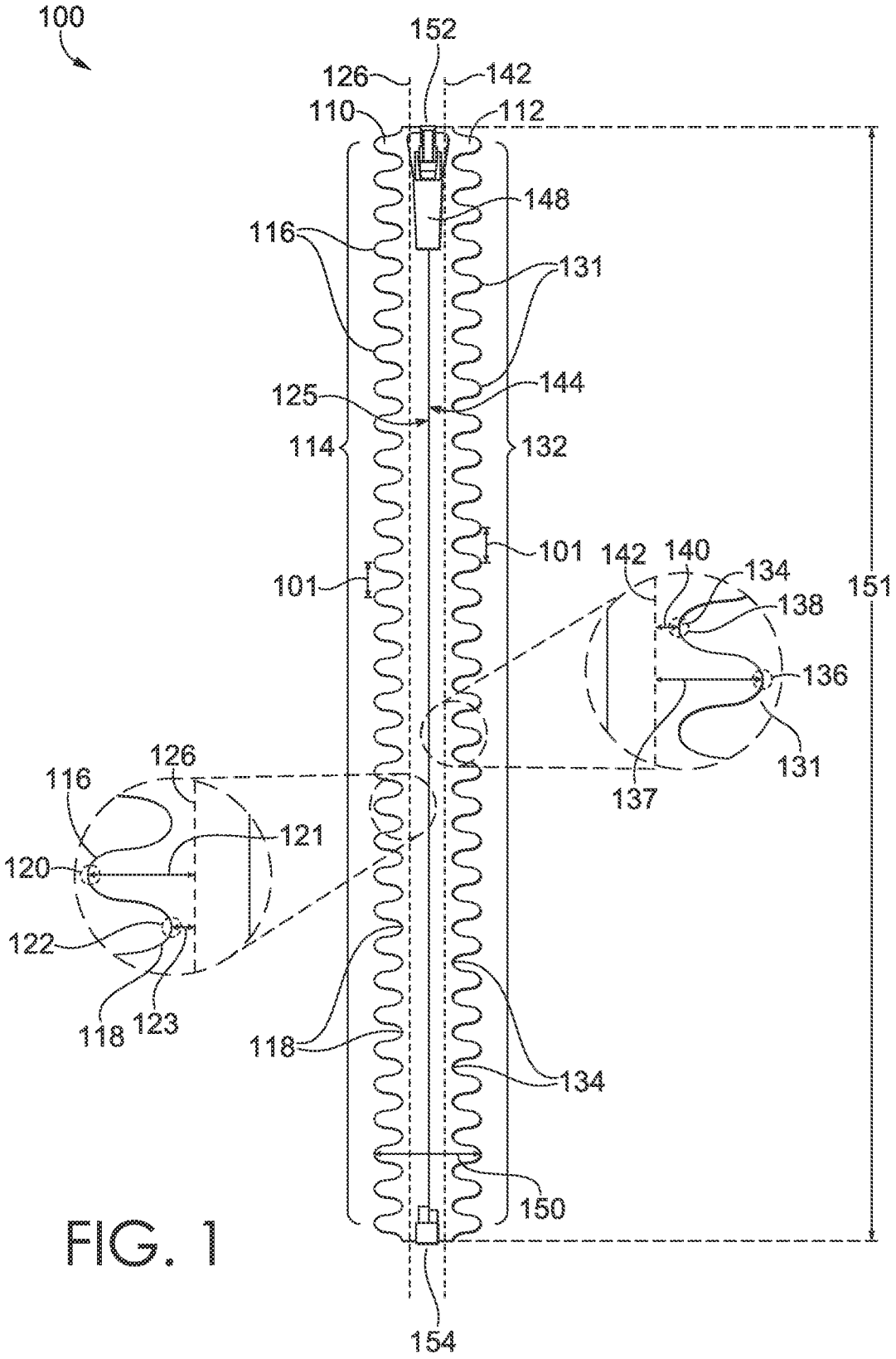
FIG. 1 illustrates an external-facing surface of an example slider assembly in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional slider assemblies used to releasably couple, for example, textile edges together generally lack the ability to flex in a direction orthogonal to the longitudinal edges of the slider assembly and/or extend in a lengthwise direction of the slider assembly. Thus, an article of apparel incorporating a traditional slider assembly may lack freedom-of-movement when the article of apparel is subject to tensioning forces in particular directions. Additionally, traditional slider assemblies often lack breathability and permeability features thus trapping heated air and/or moisture vapor inside the article of apparel when the article of apparel is worn which may cause discomfort to a wearer. Aspects herein provide for a slider assembly that is configured to articulate or flex in a widthwise direction of the slider assembly (i.e., in a direction orthogonal to the longitudinal edges of the slider assembly) and, in some aspects, to extend in a longitudinal direction of the slider assembly allowing for greater freedom-of-movement in an article of apparel incorporating the slider assembly. As well, the slider assembly is incorporated into the article of apparel in such a way that small spaces are formed at intervals along the length of the slider assembly which enhances breathability and permeability features of the article of apparel.

At a high level, aspects herein are directed to a slider assembly having a first slider tape and a second slider tape. The first slider tape has a first longitudinal edge that includes a first series of alternating peaks and troughs and a second longitudinal edge that is linear and to which a first set of coupling elements are attached. The second slider tape has a third longitudinal edge that includes a second series of alternating peaks and troughs and a fourth longitudinal edge that is linear and to which a second set of coupling elements are attached. In use, the first and second sets of coupling elements are adapted to be releasably engaged with each other. Configuring the slider assembly to include edges formed of alternating peaks and troughs enables the slider assembly to flex or articulate in a widthwise direction. For instance, in response to a force transmitted generally across the width of the slider assembly, adjacent peaks on one of the slider tapes may bias toward each other and adjacent peaks on the opposite slider tape may bias away from each other enabling the slider assembly to flex in the widthwise direction. In example aspects, when the slider tapes are formed of a material that exhibits stretch and recovery properties, the slider assembly may also extend in a longitudinal direction when subject to a longitudinal tensioning force. For instance, in response to a force transmitted along the length of the slider assembly, the distance between adjacent peaks on each of the slider tapes may increase resulting in a reversible increase in the linear length of the slider assembly.

When incorporated into an article of apparel, the first longitudinal edge of the first slider tape and the third longitudinal edge of the second slider tape are affixed to textile edges of the article of apparel such that the textile edges are affixed to the peaks but are unaffixed from the troughs of the slider tapes. This results in a space or through-passage being formed between the textile edges and the respective troughs. The spaces may act as a communication path for heated air and/or moisture vapor to leave the article of apparel which may improve wearer comfort especially when the article of apparel is worn by the wearer in exercise conditions.

As used herein, the term "article of apparel" encompasses any number of products meant to be worn by a wearer including upper-body garments (e.g., shirts, jackets, hoodies, pullovers), lower-body garments (e.g., pants, shorts, leggings), articles of footwear such as shoes or socks, articles of headwear (e.g., hats and hoods), gloves, stand-alone sleeves (e.g., arm sleeves, calf sleeves), and the like. The term article of apparel may also refer to articles used by a wearer such as a backpack, a purse, a duffel bag, a tote bag, and the like.

Positional terms used when describing the slider assembly and/or an article of apparel incorporating the slider assembly such as "external-facing," "internal-facing," and the like are with respect to the slider assembly and/or article of apparel being used as intended by a wearer standing upright. As such, the internal-facing surface of the slider assembly and/or article of apparel is configured to face inwardly toward the wearer and/or toward an interior volume when the article is, for instance, a duffel bag, and the external-facing surface of the slider assembly and/or article of apparel is configured to face outwardly and away from the wearer and/or away from an interior volume when the article is in the form of, for example, a duffel bag. The term "edge" as used herein means a terminal end or edge of a respective structure. The term "about" as used herein means within ±5% of an indicated value.

The term "slider assembly" as used herein encompasses any slider technology that is used to releasably couple, for example, textile edges of an article of apparel together. Thus, the slider assembly may include a zipper assembly, a groove and hook assembly, a rail and track assembly, and the like. The term "coupling element" may include different components depending on the type of slider assembly such as, for example, zipper teeth, a groove, hooks, rails, tracks, and the like.

As used herein, the term "peak" may be defined as a shape having an apex region that is located a first distance away from an axis extending along a length of the slider tape, and a "trough" may be defined as a shape having an apex region that is located a second distance away from the axis extending along the length of the slider tape, where the second distance is less than the first distance. The term "apex region" may be defined as the region of the peak shape or the trough shape that is furthest away from or closest to the longitudinal axis respectively. The apex region may be a defined point or a more general region in example aspects. The term "linear" as used herein means an edge that extends along a straight, or nearly straight, line.

Unless indicated otherwise all measurements provided herein are measured when the slider assembly and/or the article incorporating the slider assembly are at standard ambient temperature and pressure (25 degrees Celsius or 298.15 K and 1 bar) and are in a resting or un-tensioned state.

Figure 2:
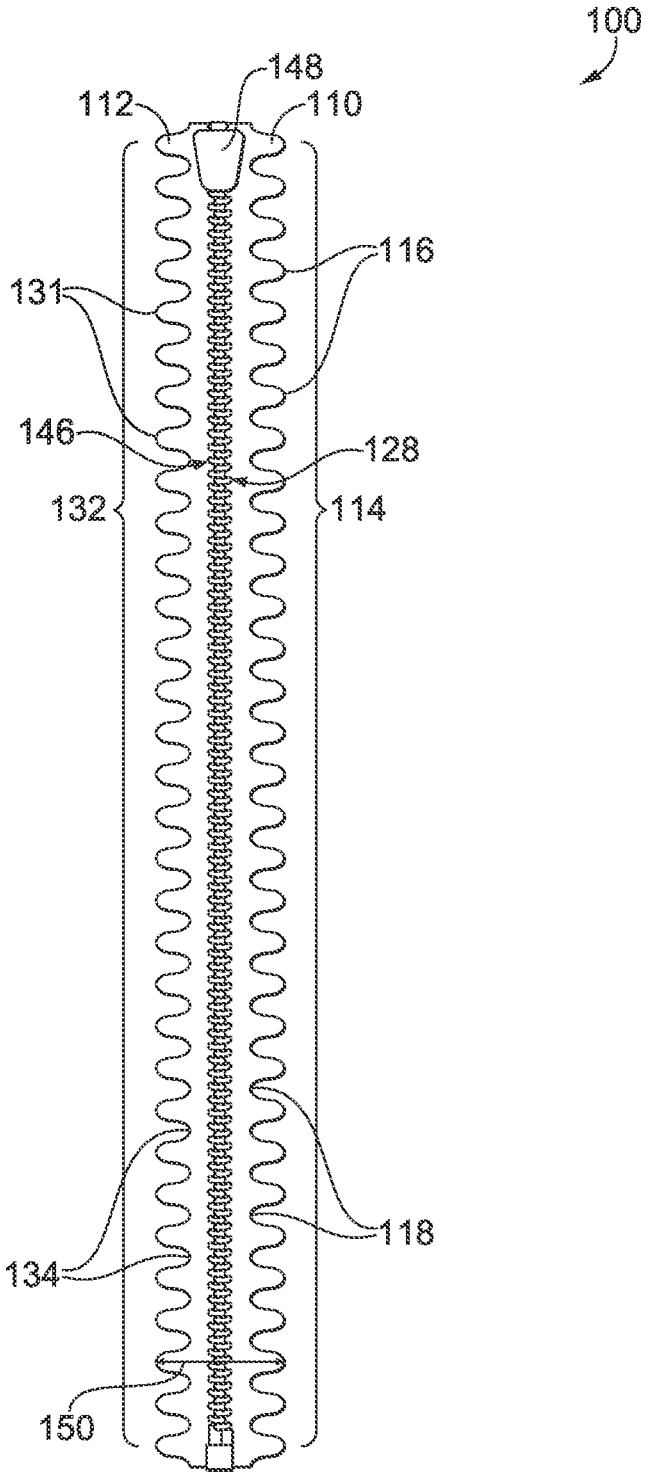
FIG. 2 illustrates an internal-facing surface of the slider assembly of FIG. 1 in accordance with aspects herein.

FIGS. 1 and 2 respectively depict an external-facing surface of a slider assembly 100 and an internal-facing surface of the slider assembly 100 in an un-tensioned or resting state. The slider assembly 100 includes a first slider tape 110 and a second slider tape 112 that extend along a longitudinal length of the slider assembly 100. The first slider tape 110 has a first longitudinal edge 114 that includes a first series of peaks 116 and a first series of troughs 118 where the peaks 116 alternate with the troughs 118. Adjacent peaks 116 are separated by a distance 101. As further shown in the magnified view of a portion of the first slider tape 110, an apex region 120 of the peaks 116 is located a first distance 121 away from a hypothetical axis 126 that extends the length of the first slider tape 110 and is positioned inwardly from the troughs 118, and an apex region 122 of the troughs 118 is located a second distance 123 away from the hypothetical axis 126; the first distance 121 is greater than the second distance 123. The first slider tape 110 further includes a second longitudinal edge 125 opposite the first longitudinal edge 114 to which a first set of coupling elements 128 are attached (shown in FIG. 2). In example aspects, the second longitudinal edge 125 is linear.

The second slider tape 112 has a third longitudinal edge 132 that includes a second series of peaks 131 and a second series of troughs 134 where the peaks 131 alternate with the troughs 134. Adjacent peaks 131 are separated by the distance 101. As further shown in the magnified view of a portion of the second slider tape 112, an apex region 136 of the peaks 131 is located a first distance 137 away from a hypothetical axis 142 that extends the length of the second slider tape 112 and is positioned inwardly from the troughs 134, and an apex region 138 of the troughs 134 is located a second distance 140 away from the hypothetical axis 142; the first distance 137 is greater than the second distance 140. The second slider tape 112 further includes a fourth longitudinal edge 144 opposite the third longitudinal edge 132 to which a second set of coupling elements 146 are attached (shown in FIG. 2). In example aspects, the fourth longitudinal edge 144 is linear. The slider assembly 100 has a width 150 as measured from the apex region 120 of a peak 116 to the apex region 136 of a peak 131 when the slider assembly 100 is in the resting or un-tensioned state. The slider assembly 100 also has a length 151 (shown in FIG. 1) measured from a first end 152 to a second end 154 of the slider assembly 100 when the slider assembly 100 is in the resting or un-tensioned state.

In example aspects, the slider assembly 100 further includes a slider pull 148 useable to engage or disengage the first set of coupling elements 128 and the second set of coupling elements 146 when an upward or a downward tensioning force is exerted on the slider pull 148. Thus, in example aspects, the slider pull 148 may be used to fully engage the first and second sets of coupling elements 128 and 146, partially engage the first and second sets of coupling elements 128 and 146, or disengage the first and second sets of coupling elements 128 and 146. In one example aspects, and as shown in FIGS. 1-2, when the first set of coupling elements 128 are engaged with the second set of coupling elements 146, the peaks 116 are aligned with the peaks 131 across the width 150 of the slider assembly 100. Similarly, when the first set of coupling elements 128 are engaged with the second set of coupling elements 146, the troughs 118 are aligned with the troughs 134 across the width 150 of the slider assembly 100. Stated differently, a first line that is orthogonal to the second longitudinal edge 125 and to the fourth longitudinal edge 144 would pass through the apex region 120 of a peak 116 and the apex region 136 of a peak 131. A second line that is orthogonal to the second longitudinal edge 125 and to the fourth longitudinal edge 144 would pass through the apex region 122 of a trough 118 and the apex region 138 of a trough 134.

Figure 3:
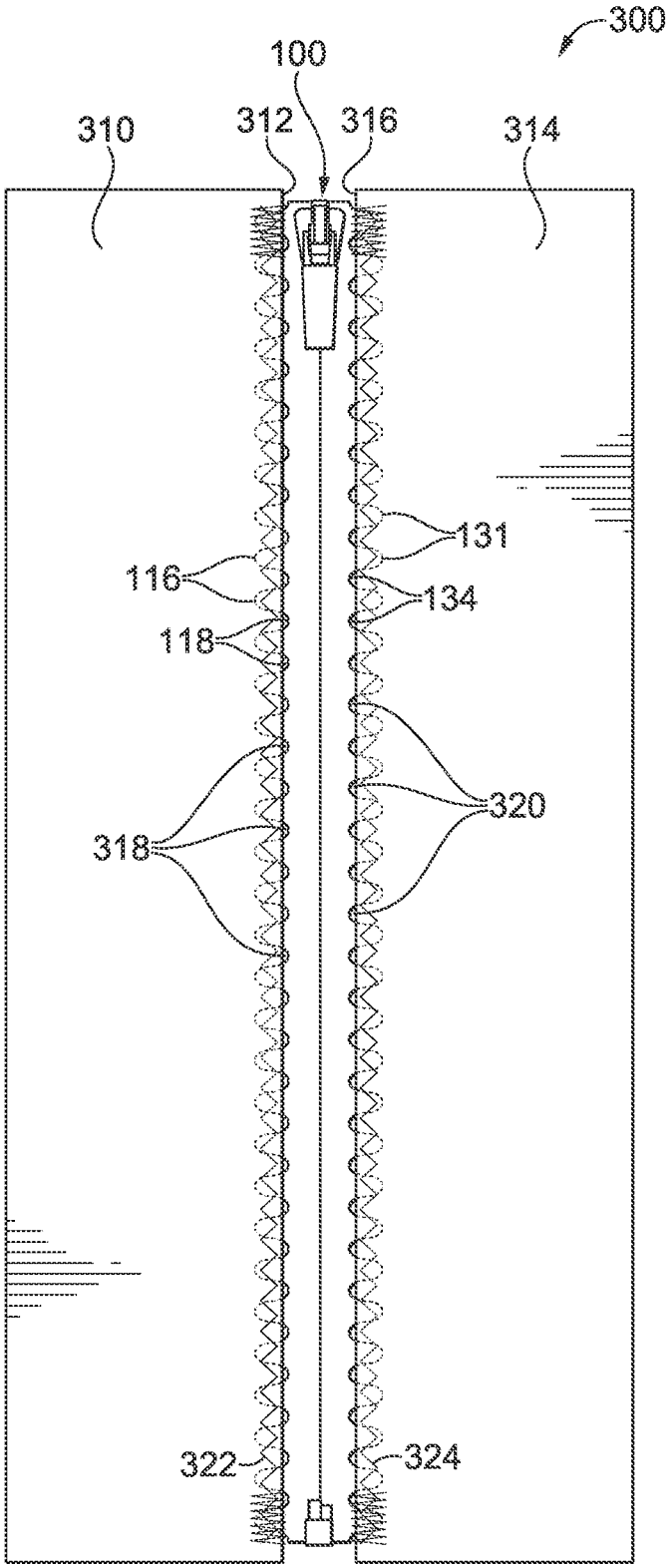
FIG. 3 illustrates an external-facing surface of an article incorporating the slider assembly of FIG. 1 in accordance with aspects herein.
Figure 4:
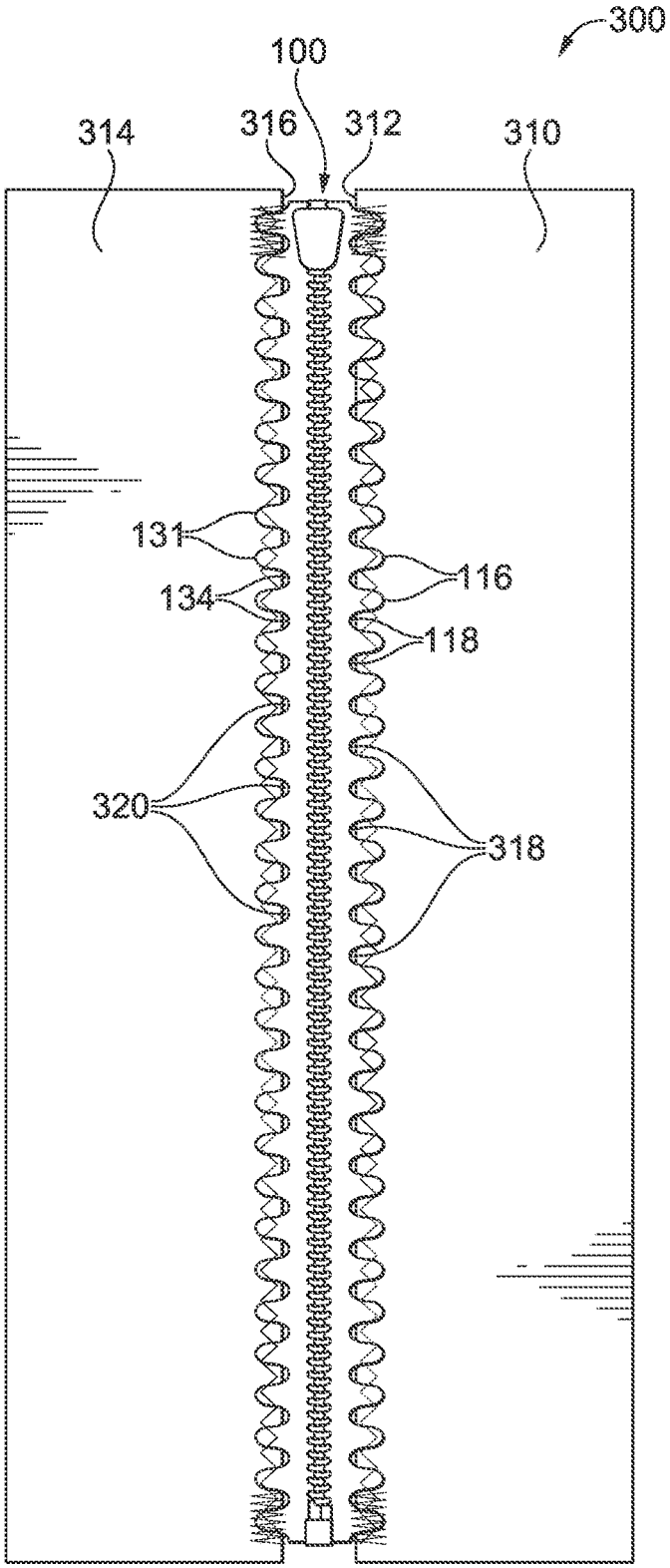
FIG. 4 illustrates an internal-facing surface of the article of FIG. 3 in accordance with aspects herein.

FIGS. 3 and 4 respectively illustrate an external-facing surface and an internal-facing surface of a portion of an article 300 incorporating the slider assembly 100. As shown in FIGS. 3 and 4, the article 300 includes a first textile 310 having a first textile edge 312 and a second textile 314 having a second textile edge 316. The slider assembly 100 is positioned adjacent the internal-facing surface of the first textile 310 and the second textile 314 as shown in FIG. 4. The first longitudinal edge 114 of the first slider tape 110 is positioned such that the apex regions 120 of the first series of peaks 116 overlap (or are positioned adjacent to) and are affixed to the first textile edge 312, and the first textile edge 312 is spaced apart from the apex regions 122 of the first series of troughs 118. This results in a first series of spaces 318 between the first textile edge 312 and the apex regions 122 of the first series of troughs 118. In a similar manner, the third longitudinal edge 132 of the second slider tape 112 is positioned such that the apex regions 136 of the second series of peaks 131 overlap (or are positioned adjacent to) and are affixed to the second textile edge 316, and the second textile edge 316 is spaced apart from the apex regions 138 of the second series of troughs 134. This results in a second series of spaces 320 between the second textile edge 316 and the apex regions 138 of the second series of troughs 134. The first and second series of spaces 318 and 320 are through-passages and provide a fluid communication path between the external-facing surface of the article 300 and the internal-facing surface of the article 300.

In example aspects, the first textile edge 312 may be secured to the apex regions 120 of the first series of peaks 116 by stitching, adhesives, spot welding, bonding, and the like. In one example aspect, and as shown in FIGS. 3 and 4, the first textile edge 312 may be secured to the apex regions 120 of the first series of peaks 116 using zig-zag stitching 322 (i.e., stitching in a zig-zag configuration). Similarly, the second textile edge 316 may be secured to the apex regions 136 of the second series of peaks 131 by stitching, adhesives, spot welding, bonding, and the like. In one example aspect, and as shown in FIGS. 3 and 4, the second textile edge 316 may be secured to the apex regions 136 of the second series of peaks 131 by zig-zag stitching 324. Other affixation technologies such as bonding may be used with the zig-zag stitching 322 and 324 to strengthen the attachment of the first and second slider tapes 110 and 112 to the first and second textile edges 312 and 316.

Figure 5:
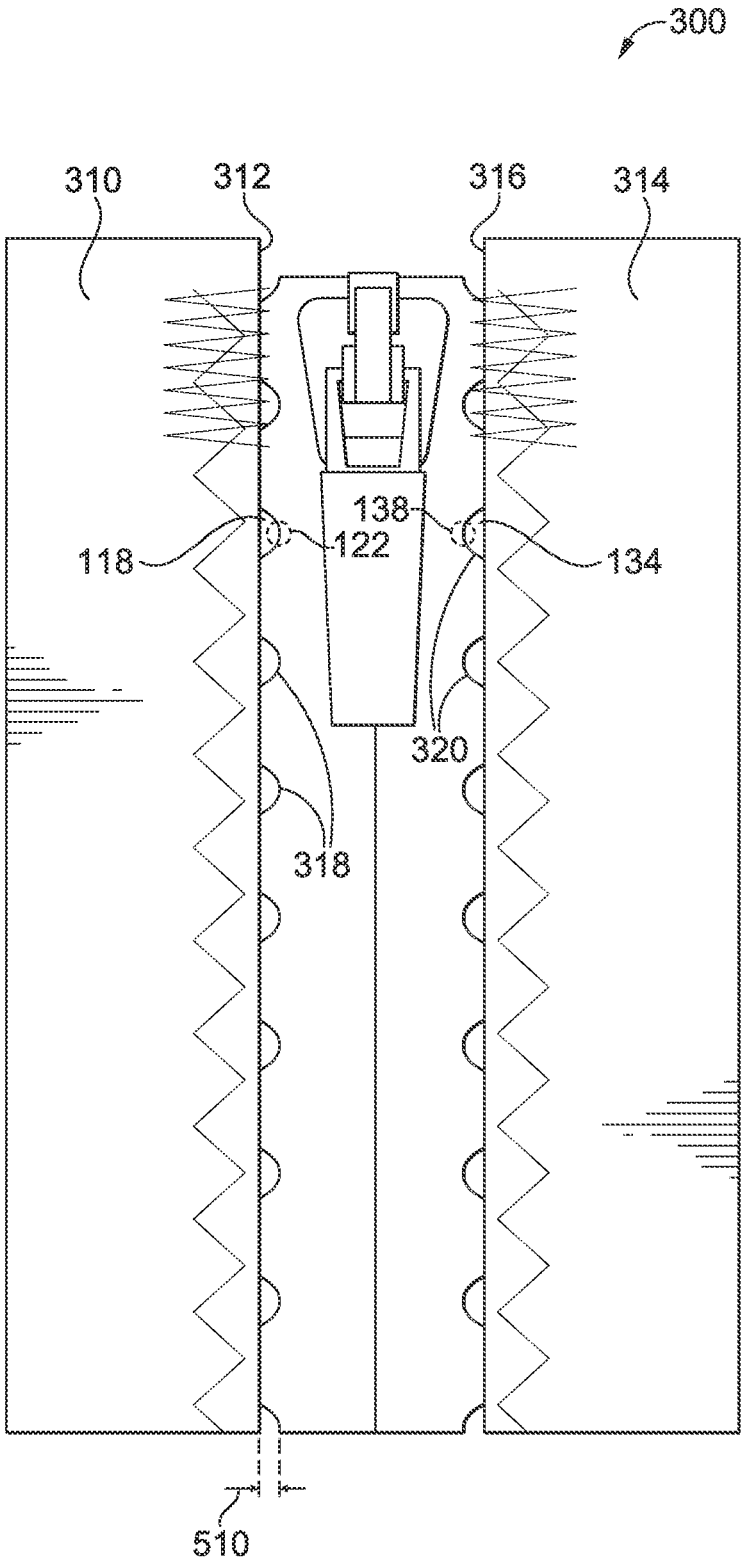
FIG. 5 illustrates a magnified view of a portion of the article of FIG. 3 in accordance with aspects herein.

FIG. 5 illustrates a magnified view of a portion of the article 300 of FIG. 3. As explained above, because the first textile edge 312 and the second textile edge 316 are affixed just to the apex regions 120 and 136 of the peaks 116 and 131 respectively, the first and second series of spaces 318 and 320 are formed between the first and second textile edges 312 and 316 and the apex regions 122 and 138 of the troughs 118 and 134. In example aspects, a distance or width 510 between the first and second textile edges 312 and 316 and the apex regions 122 and 138 of the troughs 118 and 134 may be from about 0.5 mm to about 3.0 mm, from about 1.0 mm to about 2.5 mm, or about 2 mm. In example aspects, the first and second series of spaces 318 and 320 may provide a fluid communication path through which heated air and/or moisture vapor may escape the article 300 thereby improving wearer comfort. The first and second series of spaces 318 and 320 may also provide a fluid communication path for air from the external environment to enter the article 300 to further cool the wearer.

Figure 6:
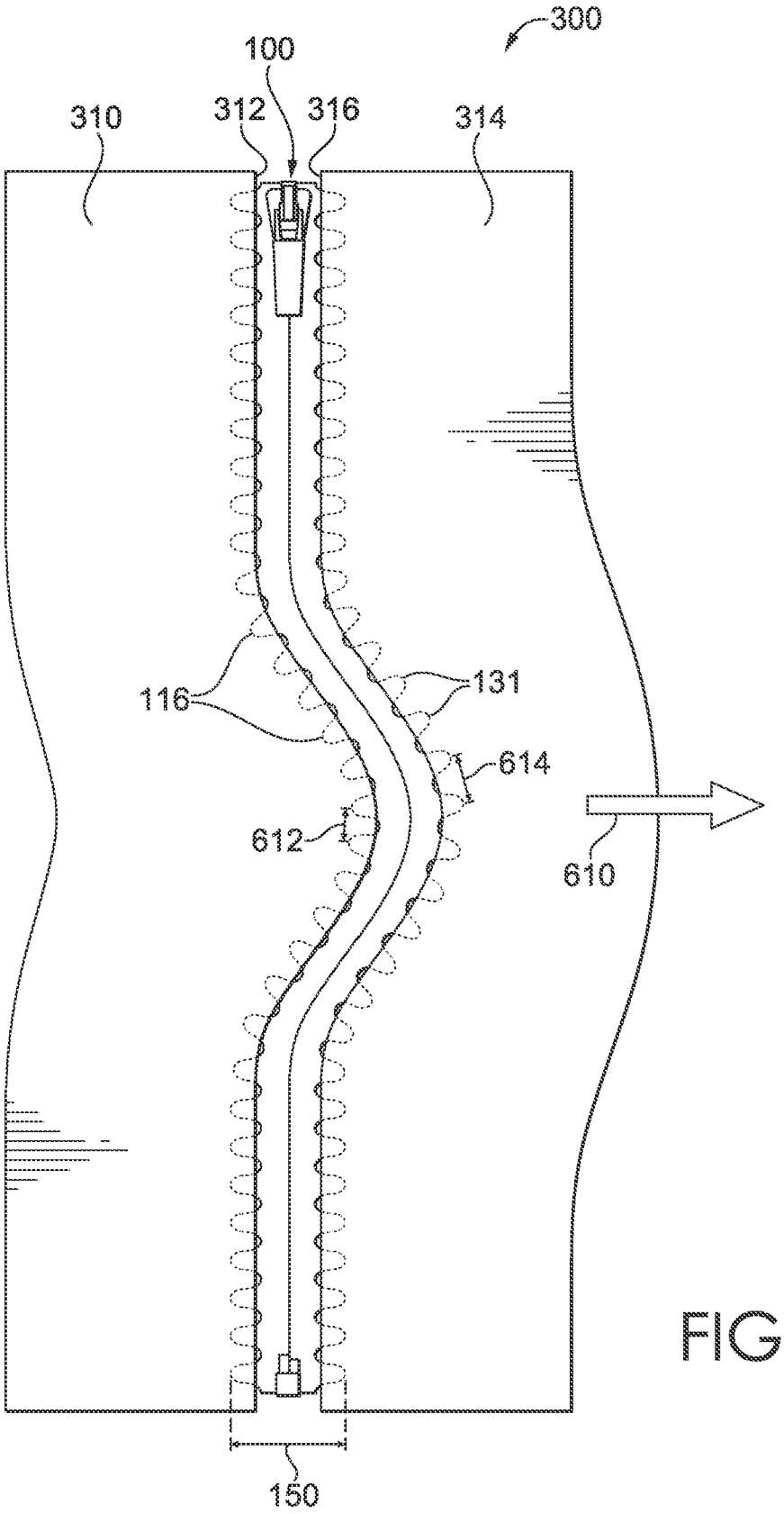
FIG. 6 illustrates the article of FIG. 3 flexed in a widthwise direction in accordance with aspects herein.

Configuring the slider assembly 100 as described herein facilitates the articulation of the slider assembly 100 in a widthwise direction. FIG. 6 depicts the article 300 and a force 610 being transmitted across the width 150 of the slider assembly 100 in the direction indicated by the arrow. In response to the force 610, the first series of peaks 116 bias toward each other. Stated differently, in response to the force 610, a distance 612 between adjacent peaks 116 decreases in the area of the slider assembly 100 subject to the force 610 where the distance 612 is less than the distance 101. As well, in response to the force 610, the second series of peaks 131 bias away from each other. Stated differently, in response to the force 610, a distance 614 between adjacent peaks 131 increases in the area of the slider assembly 100 subject to the force 610 where the distance 614 is greater than the distance 101. The combination of these two actions enables the slider assembly 100 to bend or flex in the direction of the force 610 thereby improving freedom-of-movement of the article 300. Although the force 610 is shown as orthogonal to the longitudinal edges of the slider assembly 100, aspects herein contemplate that the slider assembly 100 also bends or flexes in response to forces in directions other than parallel to the longitudinal edges of the slider assembly 100.

Figure 7:
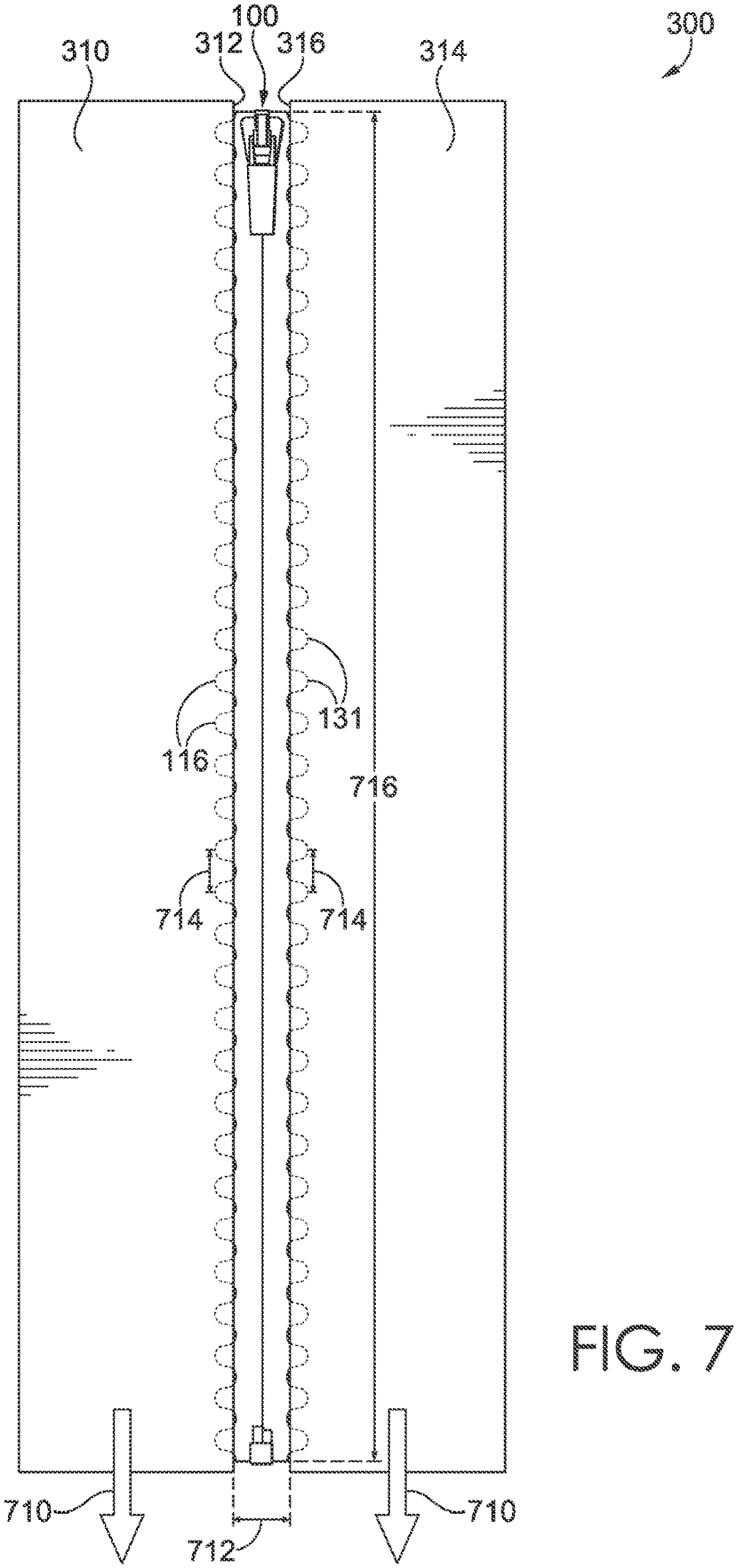
FIG. 7 illustrates the article of FIG. 3 extended in a longitudinal direction in accordance with aspects herein.

In example aspects, the first slider tape 110 and the second slider tape 112 may be formed, or at least partially formed from materials having elastic properties (i.e., stretch and recovery properties) such as, for example, elastic yarns including spandex (known by the trade name Lycra®), elastane, and the like. In further example aspects, the first textile 310 and the second textile 314 of the article 300 may also be formed, or at least partially formed from materials having elastic properties. In these examples, the shape configuration of the first and second slider tapes 110 and 112 (e.g., the first and second series of peaks 116 and 131, and the first and second series of troughs 118 and 134) and the use of zig-zag stitching may enable the slider assembly 100 to reversibly stretch in a lengthwise direction as shown in FIG. 7. That is, when a longitudinal force 710 is applied to the slider assembly 100, the apexes of the peaks 116 and 131 are drawn toward a midline of the slider assembly 100 thereby decreasing the width of the slider assembly from the width 150 to a new width 712 where the width 712 is less than the width 150. Continuing, the longitudinal force 710 further causes the distance between adjacent peaks of the first series of peaks 116 and the second series of peaks 131 to increase to a new distance 714 where the distance 714 is greater than the distance 101. The spacing between adjacent peaks of the zig-zag stitching may also increase causing the slider assembly 100 to reversibly increase to a new length 716 where the length 716 is greater than the length 151. Once the longitudinal force 710 is removed, the slider assembly 100 may revert to its original length 151 due to the elastic properties of the slider assembly 100. The reversible increase in length of the slider assembly 100 may help increase the freedom-of-movement features of the article 300. Although the force 710 is shown as being in a downward direction, it is contemplated herein that the force 710 may be in an upward direction.

Figure 8:
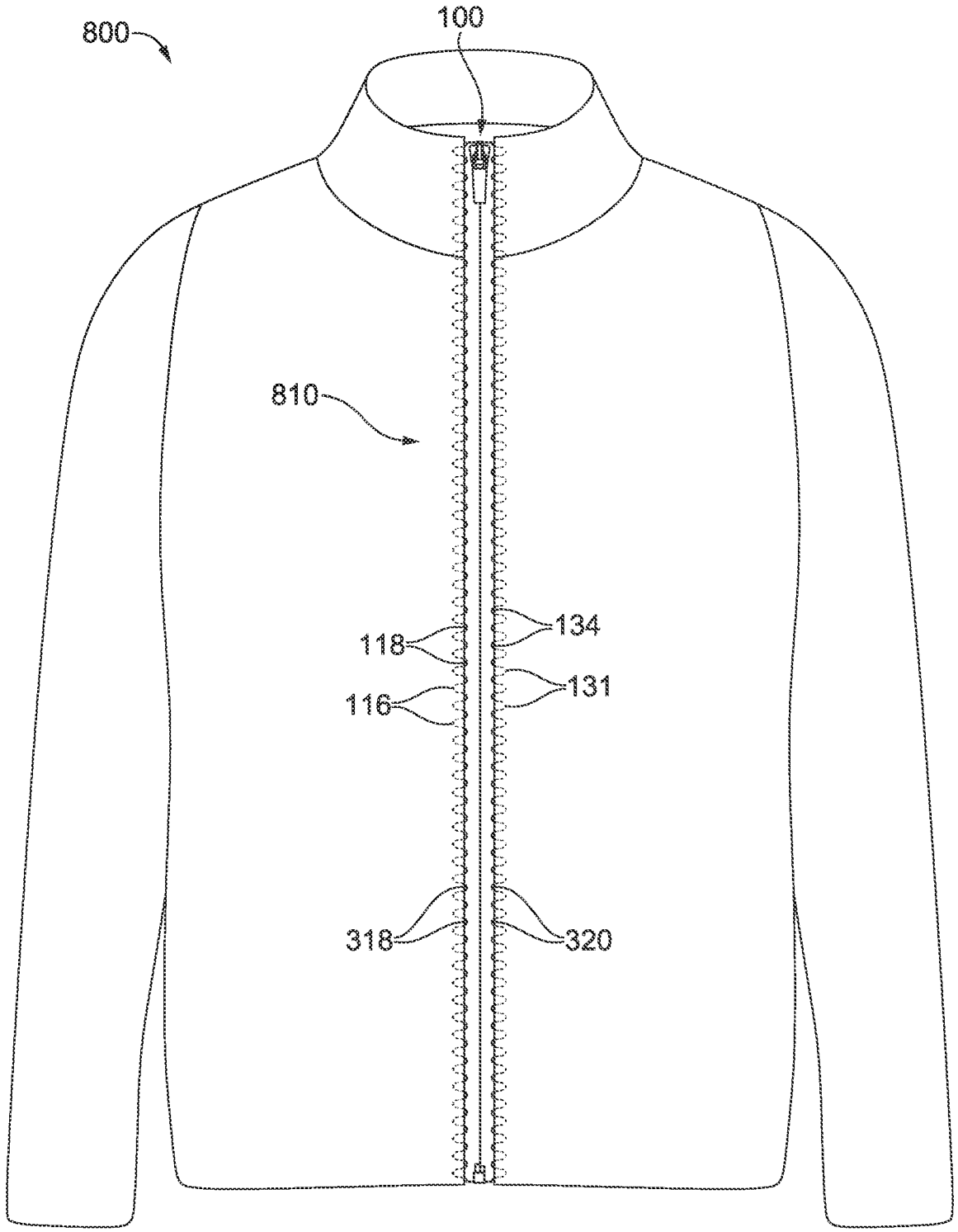
FIG. 8 illustrates a front view of an example upper-body garment incorporating the example slider assembly of FIG. 1 in accordance with aspects herein.

The slider assembly 100 may be incorporated into a number of different articles of apparel. For instance, the slider assembly 100 may be incorporated into an upper-body garment as shown in FIG. 8. FIG. 8 depicts an upper-body garment 800 in the form of a jacket. The slider assembly 100 is incorporated into the upper-body garment 800 as a center front closure 810 although it is contemplated herein that the slider assembly 100 may be used in other locations such as, for example, a pocket closure, a hood attachment, a sleeve attachment, and the like. The use of the slider assembly 100 in the upper-body garment 800 may increase the ability of the garment 800 to stretch in a lengthwise direction along the center front closure 810 as shown in FIG. 7 and/or to flex or bend in a widthwise direction of the center front closure 810 as shown in FIG. 6. Additionally, the first and second series of spaces 318 and 320 increase the ability of the upper-body garment 800 to discharge heated air and/or moisture vapor from an interior of the garment 800 to the external environment. Although the garment 800 is shown as a jacket, it is contemplated herein that the garment 800 may be in other forms such as a vest, a shirt, a pullover, a hoodie, and the like. Any and all aspects, and any variation thereof, are contemplated as being within aspects herein.

Figure 9:
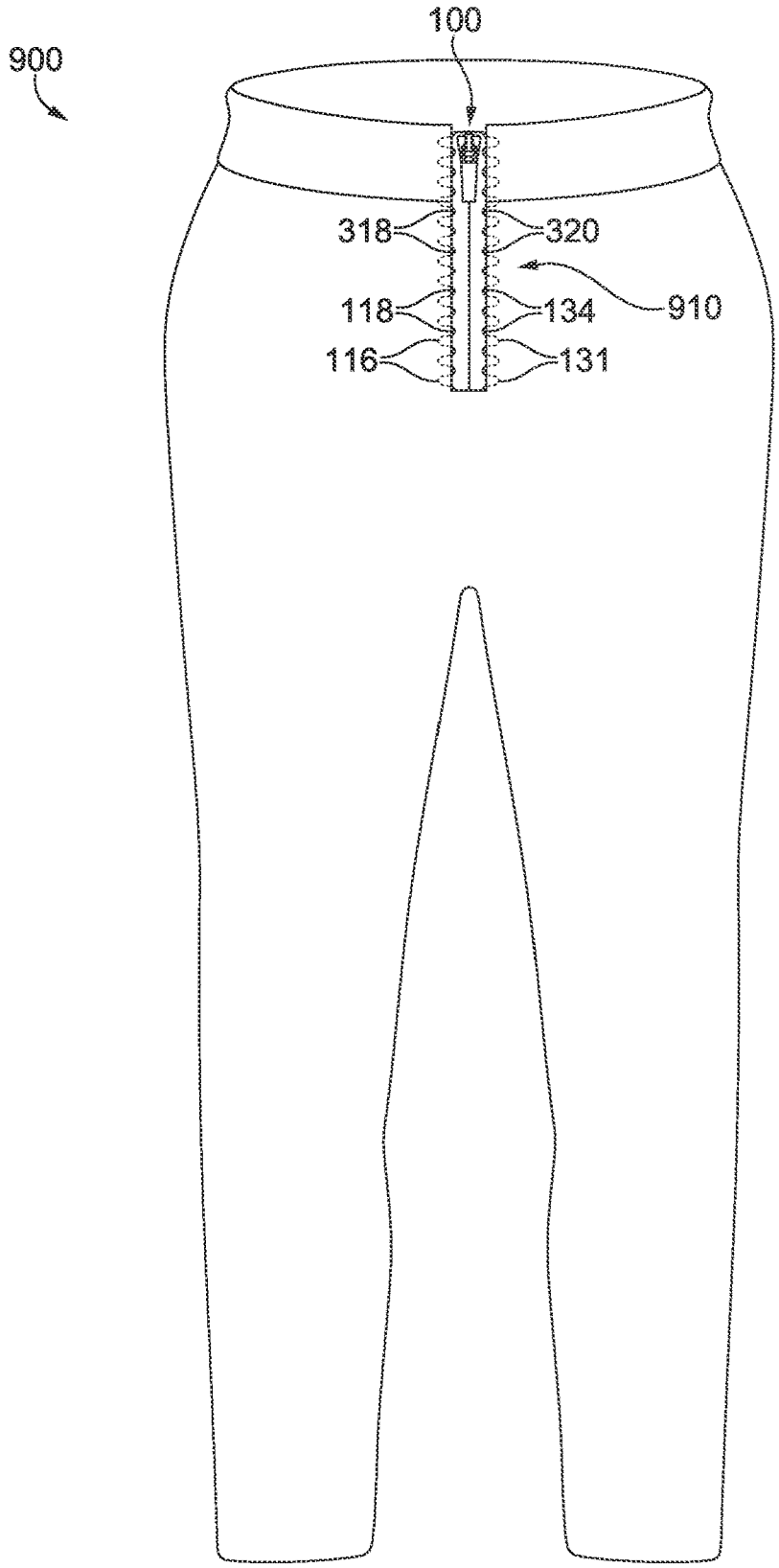
FIG. 9 illustrates a front view of an example lower-body garment incorporating the example slider assembly of FIG. 1 in accordance with aspects herein.

FIG. 9 illustrates a lower-body garment 900 incorporating the slider assembly 100 as a center front closure 910 although it is contemplated herein that the slider assembly 100 may be used in other locations such as, for example, a pocket closure, a leg portion attachment, and the like. Similar to the upper-body garment 800, the use of the slider assembly 100 in the lower-body garment 900 enhances freedom-of-movement features of the garment 900 and also increases the permeability and/or breathability features of the garment 900. Although the garment 900 is shown as a pant, it is contemplated herein that the garment 900 may be in other forms such as a short, a three-quarter pant, a unitard, and the like. Any and all aspects, and any variation thereof, are contemplated as being within aspects herein.

Figure 10:
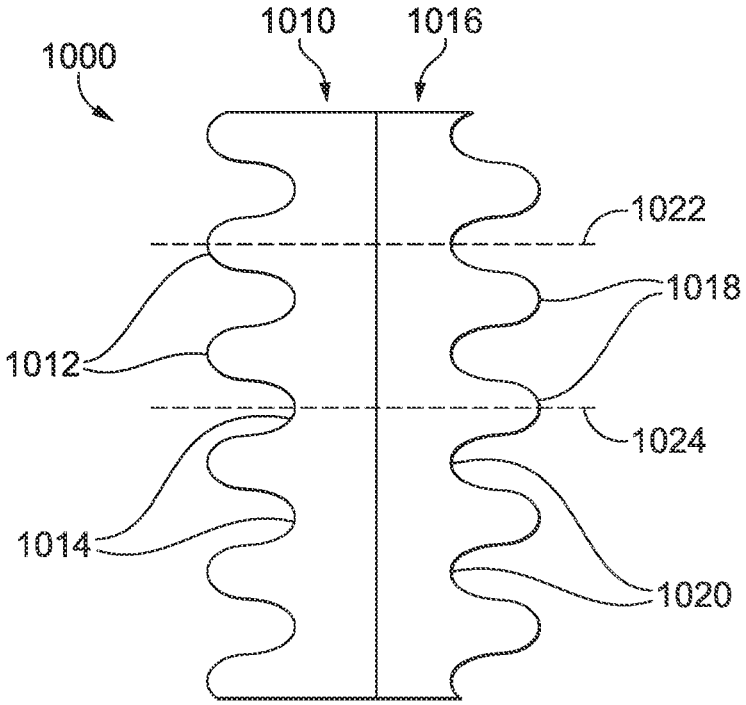
FIGS. 10-11 illustrate an external-facing surface of a portion of some alternative example slider assemblies in accordance with aspects herein.
Figure 11:
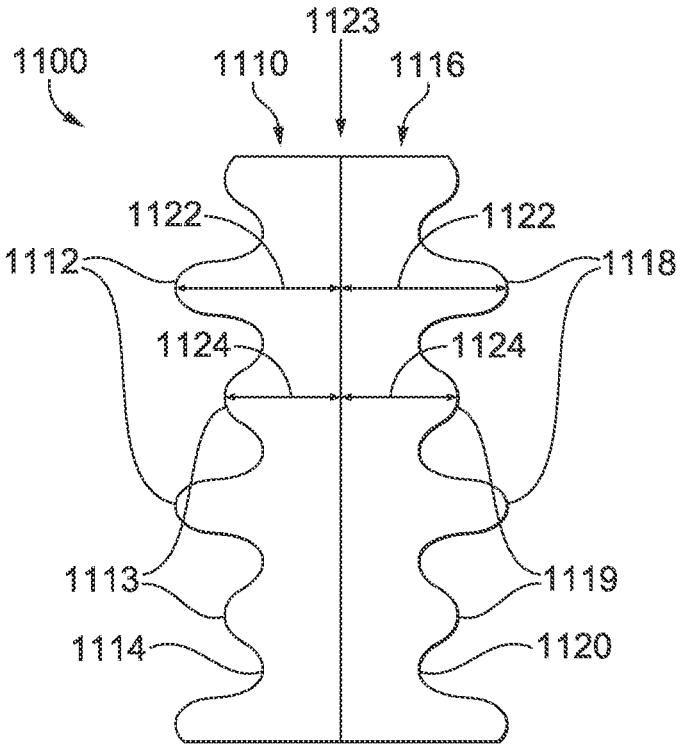

FIGS. 10 and 11 depict an external-facing surface of a portion of some alternative example slider assemblies. FIG. 10 depicts a portion of a slider assembly 1000 that includes a first slider tape 1010 having a first series of peaks 1012 that alternate with a first series of troughs 1014. The slider assembly 1000 also includes a second slider tape 1016 that includes a second series of peaks 1018 that alternate with a second series of troughs 1020. Unlike the slider assembly 100, a peak 1012 on the first slider tape 1010 is aligned across a width of the slider assembly 1000 with a trough 1020 on the second slider tape 1016. Stated differently, a first line 1022 that is orthogonal to the longitudinal edges of the slider assembly 1000 passes through a peak 1012 on the first slider tape 1010 and a trough 1020 on the second slider tape 1016. Additionally, a second line 1024 that is orthogonal to the longitudinal edges of the slider assembly 1000 passes through a trough 1014 on the first slider tape 1010 and a peak 1018 on the second slider tape 1016.

FIG. 11 depicts a portion of an example slider assembly 1100 that includes a first slider tape 1110 that has a first series of peaks 1112 and a second series of peaks 1113 where each of the first series of peaks 1112 and the second series of peaks 1113 alternate with a first series of trough 1114. The slider assembly 1100 further includes a second slider tape 1116 that has a third series of peaks 1118 and a fourth series of peaks 1119 where each of the third series of peaks 1118 and the fourth series of peaks 1119 alternate with a second series of troughs 1120. Unlike the slider assemblies 100 and 1000 where each of the peaks on the first and second slider tapes are positioned a same distance away from a longitudinal midline of the slider assembly, the first series of peaks 1112 and the third series of peaks 1118 are positioned a first distance 1122 from a midline 1123 of the slider assembly 1100, and the second series of peaks 1113 and the fourth series of peaks 1119 are positioned a second distance 1124 from the midline 1123, where the first distance 1122 is greater than the second distance 1124. Although each of the first and second series of troughs 1114 and 1120 are shown as positioned a same distance away from the midline 1123, it is contemplated herein that one or more of the first and/or second series of troughs 1114 and 1120 may be positioned different distances away from the midline 1123. Any and all aspects, and any variation thereof, are contemplated as being within aspects herein.

Figure 12:
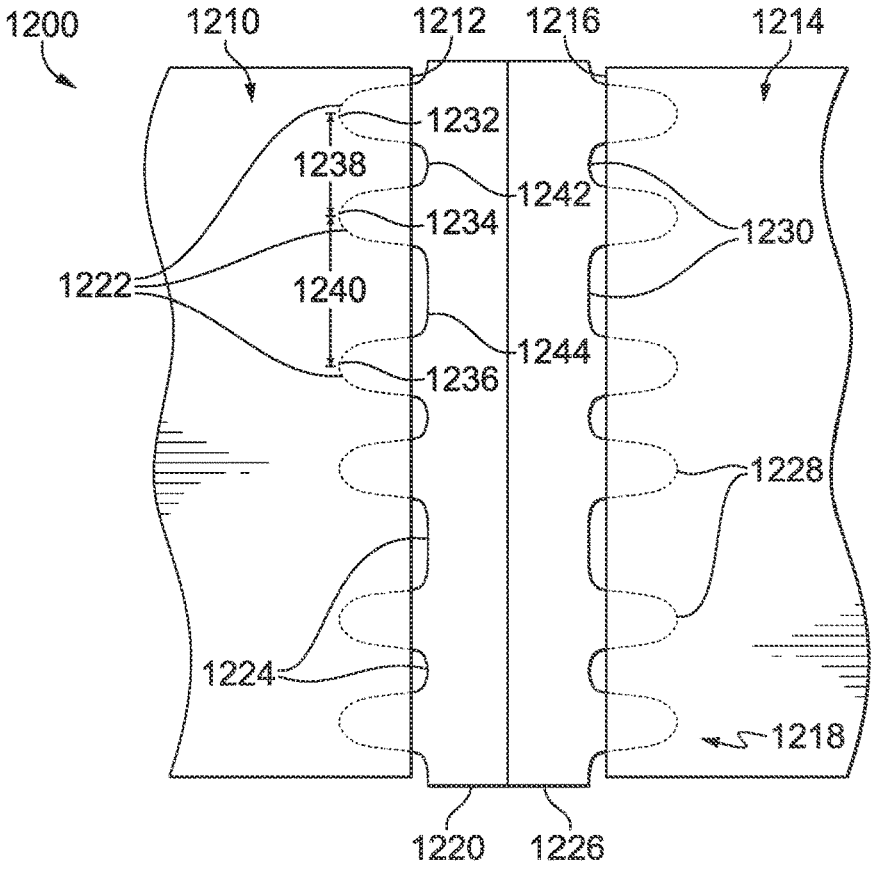
FIGS. 12-13 illustrate an external-facing surface of a portion of an article incorporating some alternative example slider assemblies in accordance with aspects herein.

FIG. 12 depicts an external-facing surface of a portion of an article 1200 having a first panel 1210 with a first panel edge 1212 and a second panel 1214 with a second panel edge 1216. A slider assembly 1218 is incorporated into the article 1200. The slider assembly 1218 includes a first slider tape 1220 having a longitudinal edge that has a first series of peaks 1222 that alternate with a first series of troughs 1224. The slider assembly 1218 additionally includes a second slider tape 1226 that has a second series of peaks 1228 that alternate with a second series of troughs 1230. Unlike the other slider assemblies depicted herein, such as the slider assemblies 100, 1000, and 1100, a distance between adjacent peaks varies. For instance, with respect to the first series of peaks 1222, a peak 1232 is spaced apart from an adjacent peak 1234 by a distance 1238, and the peak 1234 is spaced apart from an adjacent peak 1236 by a distance 1240 where the distance 1240 is greater than the distance 1238. The configuration described causes a length of the spaces formed between the first and second panel edges 1212 and 1216 and the first and second series of troughs 1224 and 1230 to vary. For instance, a space 1242 may have a length that is less than a length of a space 1244 based on the distance 1238 between adjacent peaks 1232 and 1234 being less than the distance 1240 between adjacent peaks 1234 and 1236. The result of this configuration is that breathability features of the slider assembly 1218 may vary along a length of the slider assembly 1218.

Figure 13:
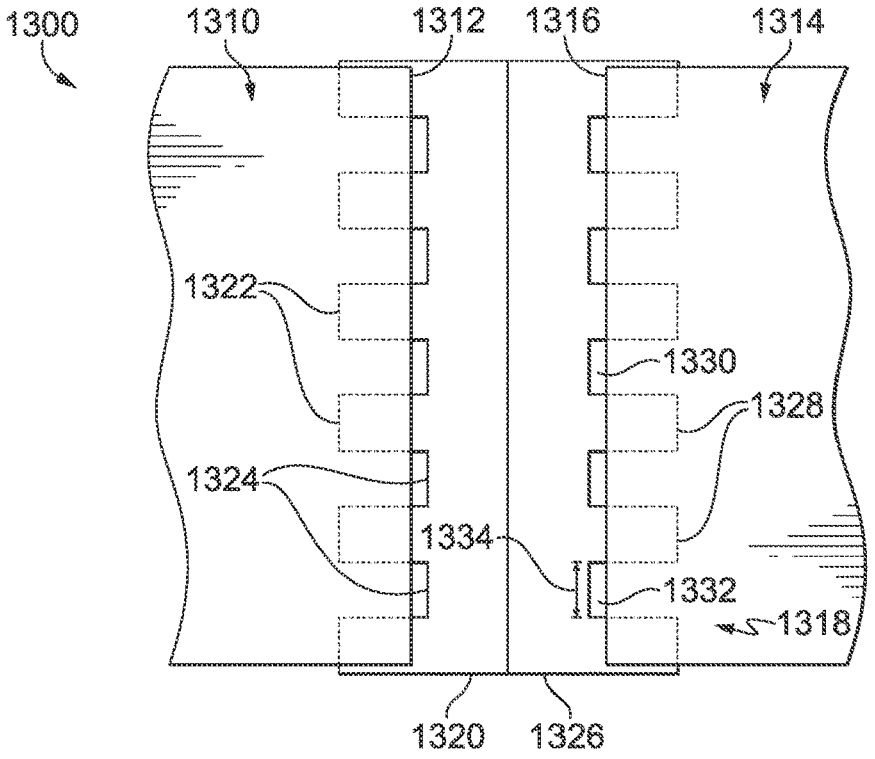

FIG. 13 depicts an external-facing surface of a portion of another article 1300 having a first panel 1310 with a first panel edge 1312 and a second panel 1314 with a second panel edge 1316. The article 1300 incorporates a slider assembly 1318. The slider assembly 1318 includes a first slider tape 1320 having a first series of peaks 1322 alternating with a first series of troughs 1324 and a second slider tape 1326 having a second series of peaks 1328 alternating with a second series of troughs 1330. Instead of the apex regions of the peaks and troughs being rounded as shown with the other slider assemblies described herein, the peaks 1322 and 1328 and the troughs 1324 and 1330 are squared off (i.e., each includes two right angles separated by a linear segment). This configuration may result in a longer length of spaces formed between the first and second panel edges 1312 and 1316 and the troughs 1324 and 1330. For instance, space 1332 has a length 1334 that may be greater than, for instance, a length of the spaces 318 and 320 in FIG. 3. Using a configuration for a slider assembly as shown in FIG. 13 may increase the overall breathability/permeability features of an article.

The configurations of the slider assemblies shown in FIGS. 10-13 are illustrative only and it is contemplated herein that slider assemblies may include other configurations including combinations of the configurations described herein.

Figure 14:
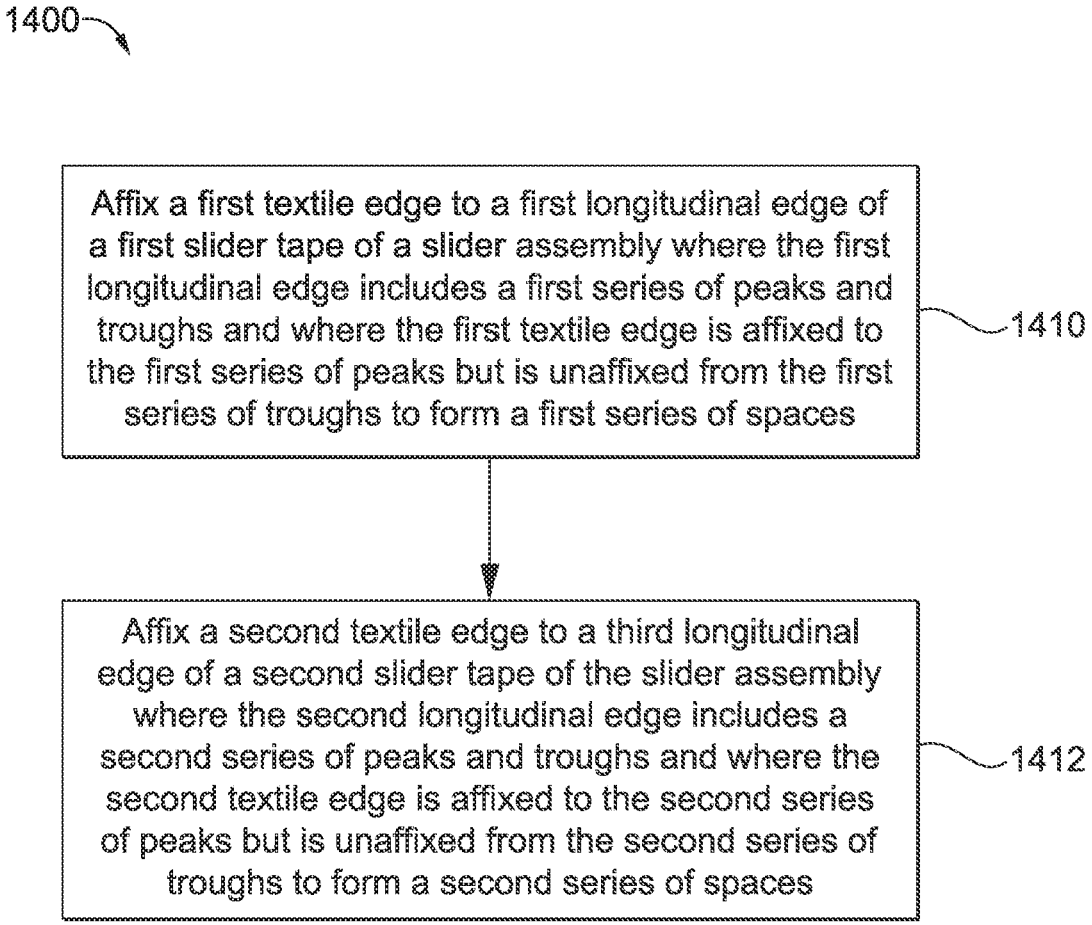
FIG. 14 illustrates a flow diagram of an example method of manufacturing an article of apparel incorporating an example slider assembly in accordance with aspects herein.

FIG. 14 depicts a flow diagram of an example method 1400 of manufacturing an article of apparel incorporating a slider assembly as described herein. At a step 1410, a first textile edge, such as the first textile edge 312 of the article 300 is affixed to a first longitudinal edge of a first slider tape of a slider assembly, such as the first longitudinal edge 114 of the first slider tape 110 of the slider assembly 100. The first longitudinal edge includes a first series of alternating peaks and troughs such as the first series of peaks 116 and the first series of troughs 118. In example aspects, the first textile edge is affixed to the first series of peaks and is unaffixed from the first series of troughs so that a first series of spaces, such as the first series of spaces 318 is formed between the first textile edge and respective troughs of the first series of troughs. The first slider tape further includes a second longitudinal edge, such as the second longitudinal edge 125, to which a first set of coupling elements is attached, such as the first set of coupling elements 128. The second longitudinal edge may be linear in example aspects.

At a step 1412, a second textile edge, such as the second textile edge 316 of the article 300 is affixed to a third longitudinal edge of a second slider tape of the slider assembly, such as the third longitudinal edge 132 of the second slider tape 112 of the slider assembly 100. The third longitudinal edge includes a second series of alternating peaks and troughs such as the second series of peaks 131 and the second series of troughs 134. In example aspects, the second textile edge is affixed to the second series of peaks and is unaffixed from the second series of troughs so that a second series of spaces, such as the second series of spaces 320 is formed between the second textile edge and respective troughs of the second series of troughs. The second slider tape further includes a fourth longitudinal edge, such as the fourth longitudinal edge 144, to which a second set of coupling elements is attached, such as the second set of coupling elements 146. The fourth longitudinal edge may be linear in example aspects.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An article of apparel incorporating a slider assembly, the article of apparel comprising:

a first textile having a first textile edge and a second textile having a second textile edge;

a first slider tape of the slider assembly, the first slider tape having a first longitudinal edge that includes a first series of alternating peaks and troughs and a second longitudinal edge opposite the first longitudinal edge to which a first set of coupling elements are attached, wherein the first textile edge is affixed to the first series of peaks and is unaffixed from the first series of troughs such that a space is formed between the first textile edge and respective troughs of the first series of troughs; and a second slider tape of the slider assembly, the second slider tape having a third longitudinal edge that includes a second series of alternating peaks and troughs and a fourth longitudinal edge opposite the third longitudinal edge to which a second set of coupling elements are attached, wherein the second textile edge is affixed to the second series of peaks and is unaffixed from the second series of troughs such that a space is formed between the second textile edge and respective troughs of the second series of troughs.

2. The article of apparel incorporating the slider assembly of claim 1, wherein the second longitudinal edge of the first slider tape is linear, and wherein the fourth longitudinal edge of the second slider tape is linear.

3. The article of apparel incorporating the slider assembly of claim 1, wherein the first slider tape is affixed to an internal-facing surface of the first textile, and wherein the second slider tape is affixed to an internal-facing surface of the second textile.

4. The article of apparel incorporating the slider assembly of claim 1, wherein the first textile edge is affixed to the first series of peaks of the first slider tape using zig-zag stitching, and wherein the second textile edge is affixed to the second series of peaks of the second slider tape using zig-zag stitching.

5. The article of apparel incorporating the slider assembly of claim 1, wherein the space formed between the first textile edge and the respective troughs of the first series of troughs is from about 1.5 mm to about 2.5 mm in width.

6. The article of apparel incorporating the slider assembly of claim 1, wherein the space formed between the second textile edge and the respective troughs of the second series of troughs is from about 1.5 mm to about 2.5 mm in width.

7. The article of apparel incorporating the slider assembly of claim 1, wherein the first set of coupling elements and the second set of coupling elements comprise zipper teeth.

8. The article of apparel incorporating the slider assembly of claim 1, wherein the first set of coupling elements are either engaged with, partially engaged with, or disengaged from the second set of coupling elements.

9. The article of apparel incorporating the slider assembly of claim 8, wherein peaks in the first series of peaks of the first slider tape are aligned with peaks in the second series of peaks of the second slider tape across a width of the slider assembly when the first set of coupling elements are engaged with the second set of coupling elements.

10. The article of apparel incorporating the slider assembly of claim 8, wherein troughs in the first series of troughs of the first slider tape are aligned with troughs in the second series of troughs of the second slider tape across a width of the slider assembly when the first set of coupling elements are engaged with the second set of coupling elements.

11. The article of apparel incorporating the slider assembly of claim 8, wherein peaks in the first series of peaks of the first slider tape are aligned with troughs in the second series of troughs of the second slider tape across a width of the slider assembly when the first set of coupling elements are engaged with the second set of coupling elements, and wherein troughs in the first series of troughs of the first slider tape are aligned with peaks in the second series of peaks of the second slider tape across the width of the slider assembly when the first set of coupling elements are engaged with the second set of coupling elements.

12. A method of manufacturing an article of apparel incorporating a slider assembly, the method comprising:

affixing a first textile edge of the article of apparel to a first longitudinal edge of a first slider tape of the slider assembly, the first longitudinal edge of the first slider tape including a first series of alternating peaks and troughs, wherein the first textile edge is affixed to the first series of peaks and is unaffixed from the first series of troughs such that a space is formed between the first textile edge and respective troughs of the first series of troughs, and wherein the first slider tape further includes a second longitudinal edge opposite the first longitudinal edge to which a first set of coupling elements are attached; and affixing a second textile edge of the article of apparel to a third longitudinal edge of a second slider tape of the slider assembly, the third longitudinal edge of the second slider tape including a second series of alternating peaks and troughs, wherein the second textile edge is affixed to the second series of peaks and is unaffixed from the second series of troughs such that a space is formed between the second textile edge and respective troughs of the second series of troughs, and wherein the second slider tape further includes a fourth longitudinal edge opposite the third longitudinal edge to which a second set of coupling elements are attached.

13. The method of manufacturing the article of apparel incorporating the slider assembly of claim 12, wherein the space formed between the first textile edge and the respective troughs of the first series of troughs is from about 1.5 mm to about 2.5 mm in width, and wherein the space formed between the second textile edge and the respective troughs of the second series of troughs is from about 1.5 mm to about 2.5 mm in width.

14. The method of manufacturing the article of apparel incorporating the slider assembly of claim 12, wherein the first textile edge is affixed to the first series of peaks of the first slider tape using zig-zag stitching, and wherein the second textile edge is affixed to the second series of peaks of the second slider tape using zig-zag stitching.

* * * * *